US005871225A

United States Patent [19]

Sutherland

[11] Patent Number: 5,871,225

[45] Date of Patent: Feb. 16, 1999

[54] SHORT, WIDE SKI AND BINDING

[76] Inventor: Robert L. Sutherland, 320-23 Avenue S.W., Calgary, Canada

[21] Appl. No.: 233,216

[22] Filed: Apr. 26, 1994

Related U.S. Application Data

[63] Continuation of Ser. No. 844,588, Mar. 27, 1992, abandoned.

[30] Foreign Application Priority Data

Sep. 29, 1989 [CA] Canada ..... 615220

[51] Int. Cl.[6] ..... A63C 5/00

[52] U.S. Cl. ..... 280/609; 280/633

[58] Field of Search ..... 280/601, 607, 280/609, 617, 618, 633

[56] References Cited

U.S. PATENT DOCUMENTS

| | | | |
|---|---|---|---|
| 3,248,124 | 4/1966 | Tiesler | 280/11.35 |
| 3,314,687 | 4/1967 | Tiesler | 280/11.35 |
| 3,907,315 | 9/1975 | Charneck et al. | 280/11.13 |
| 3,926,451 | 12/1975 | Guild | 280/11.35 |
| 4,007,946 | 2/1977 | Sarver | 280/600 |
| 4,085,947 | 4/1978 | Sarver | 280/607 |
| 4,264,087 | 4/1981 | Bortoli | 280/633 |
| 4,343,485 | 8/1982 | Johnston et al. | 280/609 |
| 4,652,006 | 3/1987 | Desoutter | 280/609 |

FOREIGN PATENT DOCUMENTS

| | | |
|---|---|---|
| 372005 | 8/1983 | Austria . |
| 179728 | 6/1917 | Canada . |
| 989435 | 5/1976 | Canada . |
| 1004701 | 1/1977 | Canada . |
| 1016206 | 8/1977 | Canada . |
| 1027602 | 3/1978 | Canada . |
| 1035799 | 8/1978 | Canada . |
| 1043378 | 11/1978 | Canada . |
| 1119209 | 2/1982 | Canada . |
| 1071142 | 10/1952 | France . |
| 1248744 | 11/1960 | France . |
| 1255073 | 1/1961 | France . |
| 2282823 | 8/1974 | France . |
| 2020184 | 11/1979 | United Kingdom . |

OTHER PUBLICATIONS

Forbes, "A Ski For Powder Phobics" Nov. 22, 1993 pp. 180–181.

Cross Country Ski Magazine, (Trak Bushwacker).

*Primary Examiner*—Brian L. Johnson
*Assistant Examiner*—Michael Mar
*Attorney, Agent, or Firm*—Workman, Nydegger & Seeley

[57] ABSTRACT

A short, wide snow ski is provided having additional surface area which maintains a skier closer to the surface of powder snow. This provides the advantage of higher speeds through deep power, and in addition, the ski tips are less likely to catch on obstructed objects hidden under the snow. Other advantages of planing near the top of the snow level are more effective steering, straighter tracking, and better balance.

8 Claims, 6 Drawing Sheets

SHORT, WIDE SKI AND BINDING

This is a Continuation of Application Ser. No. 07/844,588 filed Mar. 27, 1992, now abandoned.

This invention relates to a ski, and more particularly, to a ski which may be used in a variety of snow conditions and more particularly, soft snow.

Skiing has become an extremely popular sport for people of all ages. A vast majority of the skiing, and particularly downhill skiing, is performed on ski areas in which the snow conditions are controlled by means of packing and grooming equipment. As a result ski manufacturers design and construct skis which are optimised to accommodate skiing on these groomed hills.

There are, however, skiers who would prefer to ski on ungroomed and unpacked hills or in the country where trails have not been set. Conventional downhill and cross country skis are not well suited to these soft snow conditions, as they tend to sink in the snow, and thereby drastically reduce maneuverability.

The present invention provides a ski which has the characteristic of facilitating maneuvers in the sport of skiing, including the turns of skiing downhill, the stepping movements required when walking on the flat, and the stepping movements required when climbing uphill with climbing skins or wax. The ski of the present invention is designed to remain closer the surface of soft snow when skiing downhill such that it will float, and plane, to allow foot steering. The tip of the ski will tend to remain out of the soft snow.

The ski of the present design facilitates turning and stepping movements by decreasing the ski length, increasing the ski width, and also preferably by providing for a variation of the skier's centre of gravity in the fore and aft directions on the ski. The theory behind the invention is that in soft snow, when skiing downhill in order to be maneuverable, a ski must be short, yet it still must tend to stay near the surface, with the ski tips tending to remain out of the snow so as to in effect plane. The ski therefore, must not only be short, but must also have a large area for floatation.

Also, to obtain good floatation characteristics it is desirable to be able to adjust skier's stance on the skis in order to locate the skier's center of gravity slightly posterior to what might be considered to be the static balance point of the skier on the skis. The balance point does in fact shift in the fore and aft directions during different types of ski use. The adjustment can result in the ski tips and heels sinking into the snow approximately the same amount. This concept is, of course being popularized in the new sport of wind surfing, wherein floatation, planing and foot steering are utilized. While the positioning of centre of gravity slightly rearwardly of the static balance point provides better floatation characteristics, it is then desirable to be able to return the skiers centre of gravity to the balance point for walking on the flat. Moreover, when climbing, it is important to position the skiers centre of gravity forwardly to a position ahead of the balance point.

There is disclosed in the prior art very short skis but they tend to be so short, and so small in area, as to sink so deeply into soft snow as to make walking difficult, and climbing impossible. The prior art does not disclose the necessity of increasing the ski width while decreasing the ski length in order to improve maneuverability, and to maintain surface area for floatation.

Moreover, there has not previously been suggested the necessity of balance of the center of gravity, in order to keep the ski tips just out of the snow nor that there is an advantage in being able to adjust the center of gravity forward for walking and climbing, and backward for skiing downhill. It has been indicated in the prior art to move the skier's center of gravity in an anterior-posterior direction, but there is no indication of doing this to achieve the aforementioned floatation planing, or of foot steering features. Many previous devices which teach such adjustments relate primarily to different boot sizes for rental shops. It is also noted that the previous devices of this type are much too heavy to be considered for back country hiking-type skiing in untracked snow. Known devices are also bulky, and they also raise the ski boot a considerable distance above the ski surface, thereby detracting from the ski performance. The prior art relating to adjustment contemplates a smaller range of adjustment, i.e. in the area of 7½ cms. As will be described below it appears preferable to be able to move the tip of the boot from 1.5 cm forward of the conventional boot position, to 13.5 cm back of the conventional boot position, for a total range of 15 cm. In fact it may be desirable to allow ranges much greater than 15 cm simply by adding extra bolt holes in the ski. This requirement of an increased range of adjustment also means the most serious drawback of all known devices is that they fail to take into account the flexing of the ski when a larger range of adjustment is required. The relatively thick sliding rail devices of the previous art act like "I" beams which will not flex with the ski. Known devices, therefore all make the ski much too stiff, or alternatively the fixation screws pull out. Such devices are much too heavy for ski touring, whereas the ski of the present invention, according to a specific embodiment thereof, utilizes the metal top sheet of the ski itself as the sliding rail, in order to make the device lighter, and to locate the boot flat on the ski and to make the device neater and more cosmetically acceptable. Another aspect of a specific embodiment of the present invention, as compared to the prior art, is that the adjustment is accomplished extremely rapidly, and reliably, and with no tendency to freeze up.

Therefore, the present invention seeks to provide a deep snow ski which satisfies a longstanding need for a multipurpose or touring ski which can be used for cross-country skiing and yet will still allow the enjoyment of skiing downhill without resorting to the unnatural, uncomfortable, awkward, difficult, and dangerous maneuver referred to as telemarking.

According to one aspect of the present invention there is provided a short snow ski for downhill skiing having a width, length and snow engaging surface area selected to accomplish, floating, planing and foot steering. The ski has a total width range from about 8½ cms to about 15½ cms for a total ski length from about 130 cms to 190 cms.

The ski area is preferably in the range from about 1390 $cm^2$ to about 2485 $cm^2$.

According to another aspect of the present invention there is provided a ski and binding plate combination wherein the binding plate is a thin flat plate having attachment means for receiving a ski boot binding. The binding plate and ski have interengageable flange and channel means along side edges of the ski for accommodating relative sliding movement of the binding plate and the ski while preventing separation of the binding plate in a direction normal to the upper surface. Locking means is providing for releasably affixing the binding plate at different positions in the longitudinal direction of the ski.

The invention will now be described in greater detail with reference to the attached drawings wherein.

Figure 1:
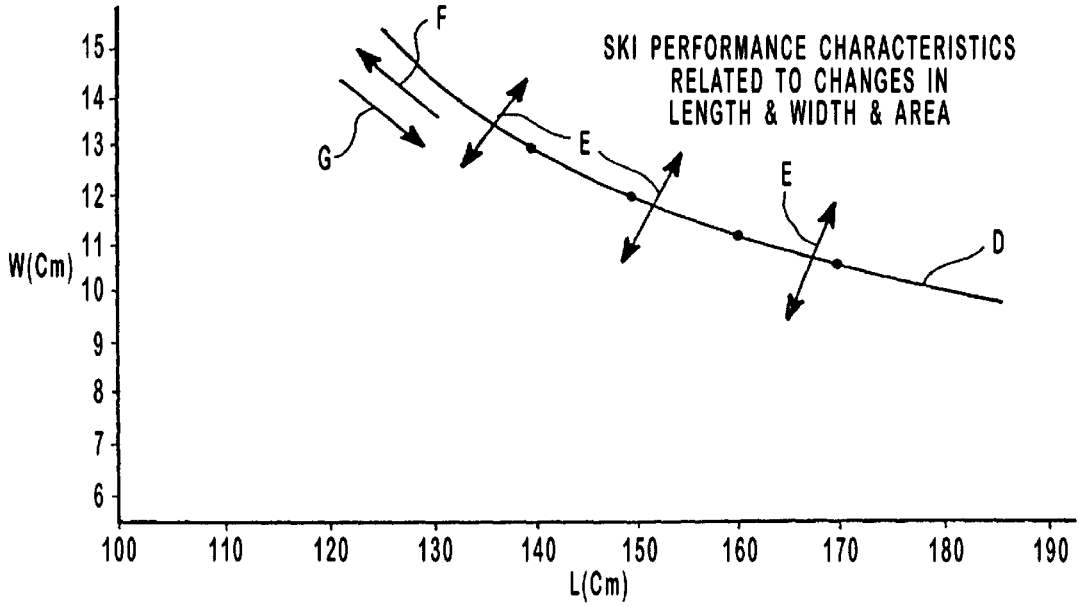
FIG. 1 is a graph of the length verses width of a ski for a 75 kilogram skier, with certain performance characteristics being indicated.

As indicated above one aspect of the present invention resides in a ski which is shorter in length than normally used by downhill skiers. The ski of the present invention provides a sufficiently large snow engaging surface that floatation and planing is obtainable in soft snow and the skier is able to foot steer. Such action is not possible with skis which are commonly available and are longer and narrower than the skis of the present invention. Referring to following Table I, skis having the lengths, widths and snow engaging or bottom surface areas identified as A were found available in a well stocked ski shop.

TABLE I

COMPARISONS OF SKI PARAMETERS (FOR A 75 Kg SKIER)

| HISTORICAL LENGTH (Cm) | WIDTH (Cm) | AREA $Cm^2$ | |
|---|---|---|---|
| 220 | 9.0 | 1980 | |
| 210 | 8.6 | 1806 | |
| 200 | 8.6 | 1720 | |
| 190 | 8.5 | 1615 | A |
| 180 | 8.5 | 1530 | |
| 170 | 8.5 | 1445 | |
| 170 | 10.6 | 1800 | |
| 160 | 11.25 | 1800 | |
| 150 | 12.0 | 1800 | B |
| 140 | 12.9 | 1800 | |
| 130 | | | |
| 120 | | | |
| 106 | 10.0 | 1060 | C |
| 100 | | | |
| 90 | | | |
| 80 | | | |
| 70 | | | |

It will be noted that for the lengths of 170 to 220 cm, the width increases generally with length, and accordingly the areas increase continuously from the areas of 1445 $cm^2$ for the shortest ski of 170 cm to 1980 $cm^2$ for the longest ski of 220 cm. For a skier of 75 Kg the preferred surface area of the ski of the present invention is approximately 1800 $cm^2$ and for lengths varying from 140 cm to a maximum of 170 cm, the preferred width therefore decreases from about 13 cm to about 10½ cms as shown at B in Table I. It is with the combination of dimensions shown for the skis of group B in Table I that a 75 Kg skier obtains the above described skiing characteristics.

There are also on the market a ski sold under the trademark SCORPION which appears to be constructed in accordance with the teachings in patents of Sarver, see U.S. Pat. Nos. 4,085,945, Apr. 25, 1978 and No. 4,007,946, Feb. 15, 1972. However, as can be seen from the dimensions shown at C on Table I, which were taken from a SCORPION ski, this ski although having a width within the range of widths proposed for the present ski, it is much shorter and thus has an area of about half of that of the present invention. Such a structure is not capable of permitting the floating, planing and foot steering achievable with the ski of the present invention.

The manner in which the parameters making up the width, length and areas shown for the skis in group B in Table I will be described in more detail below, but reference is now made to FIG. 1 which is a graph having line D, which is a plotting of the width v. length of the parameters of group B for a ski for use by a skier weighing 75 Kg (see Table III). Moving off the line upwardly in the up-direction of arrows E, the area of the ski would, of course increase while movement off the line in the down-direction of the arrows E would decrease the ski area. Increasing of the area results in better planing and floatation characteristics while a decrease results in lighter ski weight. Moving up the direction of the arrow F one line D results in widening the ski while at the same time shortening it, improves maneuverability, but an excessive increase in width increases side slippage, increases the risk of ankle twist and generally requires skiing with the feet uncomfortably separated. Movement, down along the line D, as denoted by arrow G, i.e. by making the ski longer, but narrower, does have the advantage of improving tracking or stability. An analysis of all these features and through testing, desired parameters have been established, and these involve relatively wide ranges of areas and combinations of length v. width, which provide desired results. Although optimum parameters have been indicated, it is obvious that individual skiers will have a variety of preferences, and because of different skiing techniques, all skier's do not obtain the same results by using skiis having the same parameters.

It has been found that satisfactory dimensions of the short ski of the present invention may be determined by considering skier's weights in weight groups in spans of 20 kg each. While it might first seem that the ski could be designed to provide the desirable characteristics of the invention by determining an optimum ski area (cm) per Kg weight for all skiers, it was in fact found that for satisfactory results, the surface area of the ski in contact with the snow, which is taken as being the length from the rear end to tip, multiplied by the width, which is taken as the width at its widest point must be smaller for heavier persons than light weight skiers.

Table II illustrates a break-down of skiers into weight groups of 45 to 65 Kg, 65 to 85 Kg, 85 to 105 Kg and 105 to 125 Kg which are logical intervals and appear to in total cover the weights of substantially all persons for which this type of ski would be marketed. For the sake of calculations it appears to be sufficiently accurate to work on the basis of an average weight of 55 Kg, 75 Kg, 95 Kg and 115 Kg for the four weight groups. Testing indicates that the approximate optimum snow engaging surface area required to provide the above described skiing characteristics for the four specified weight groups are 1600 $cm^2$, 1800 $cm^2$, 2000 $cm^2$ and 2200 $cm^2$, respectively but a variation of about ±13% of these values, are within an operable design. Thus as Table II indicates the ski surface area for the Weight Groups group of 45 to 65 Kgs, for example, has the range of 1600±13%, which equals approximately 1390 $cm^2$ to 1810 $cm^2$. The ranges for the other three groups are 1550 $cm^2$ to 2035 $cm^2$, 1740 $cm^2$ to 2260 $cm^2$, and 1915 $cm^2$ to 2485 $cm^2$, respectively. It can be seen that the optimum surface area per kilogram of skier weight using the optimum ski surface A divided by the average weight AWt for each group, i.e.

$$\frac{A}{AWt},$$

provides a factor for the preferred surface Area Per Kg of Skier's Wt factor, which would be approximately 29, i.e.

$$\frac{1600}{55}$$

for the ski designed for skiers of the first group. This factor for the other three groups is approximately 24, 21 and 19, respectively. If one again utilizes the 13% variation, which appears reasonable when all the design characteristics illustrated in Table II are considered, the calculation of $$\frac{(A + 13\%)}{AWt}$$

gives a range for the first groups, for example of 25 to 33 $cm^2$/Kg. By working with factors F, i.e. area of ski (cm) per Kg of skier weight, which have been established for the different weight groups, a preferred width can be calculated with the formula $$W = \frac{F \times AWt}{L}.$$

For example, using the factor F of 24 for a skier in the weight groups of 65 to 85 Kg, i.e. AWt=75, the width W would be $$\frac{24 \times 75}{170}$$

or a width of approximately 10½ cm for a 170 cm ski.

TABLE II

| WEIGHT GROUP (Kg) | 45 to 65 | 65 to 85 | 85 to 105 | 105 to 125 |
|---|---|---|---|---|
| ASSUMED AVERAGE WEIGHT FOR GROUP AWt (Kg) | 55 | 75 | 95 | 115 |
| OPTIMUM SKI SURFACE AREA A ($cm^2$) | 1600 | 1800 | 2000 | 2200 |
| ACCEPTABLE RANGE OF SKI SURFACE AREA | | | | |
| UPPER | 1810 | 2035 | 2260 | 2485 |
| LOWER | 1390 | 1550 | 1740 | 1915 |
| PREFERED SURFACE AREA PER Kg OF SKIER'S WEIGHT $cm^2$/Kg | 29 | 24 | 21 | 19 |

TABLE II-continued

| WEIGHT GROUP (Kg) | 45 to 65 | 65 to 85 | 85 to 105 | 105 to 125 |
|---|---|---|---|---|
| ACCEPTABLE RANGE OF SURFACE AREA PER Kg OF SKIER'S WEIGHT OF $cm^2$Kg | | | | |
| UPPER | 33 | 27 | 24 | 22 |
| LOWER | 25 | 21 | 18 | 15 |

Again taking into account the effect of the variations of the length, width and area, as illustrated in FIG. 1, and as a result of testing, the range of lengths 130 cm to 160 cm for the weight group of 45 to 65, 140 cm to 170 cm for the weight group of 65 to 85, 150 cm to 180 cm for the weight group of 85 to 105, and 160 cm to 190 cm for the weight group of 105 to 125, appears most acceptable. Thus, the preferred widths for the selected lengths may also be calculated by the formula of width W equals $$\frac{\text{Ski Surface Area}}{\text{Length}},$$

i.e.

$$\frac{A}{L}$$

which for the second weight group, i.e. the group of 65 to 85 Kgs, would give an optimum width of $$\frac{1800}{170},$$

or approximately 10½ cm for a ski of 170 cms, or 11¼ cm for a 160 cm ski, or 12 cm for a 150 cm ski or 13 cm for a 140 cm ski. These values are shown in the Average Columns in the Weight Group of 65 to 85 Kgs in Table III. Also these figures are those used in plotting the line D in the graph of FIG. 1. To calculate an overall acceptable range for the width, again using the above indicated accepted variation, $$W = \frac{(A \pm 13\%)}{L}$$

equals $$\frac{1390}{170}$$

or approximately 9 cm for a lower limit, and $$\frac{2035}{170}$$

or approximately 12 cm for an upper limit of the width range for a ski of a length of 170 cm. The calculated range for the selected lengths for each weight group are shown in Table III.

TABLE III

| | WEIGHT GROUP (kg) | | | | | | | | |
|---|---|---|---|---|---|---|---|---|---|
| | 45 to 65 | | 65 to 85 | | | 85 to 105 | | 105 to 125 | |
| | SKI WIDTH RANGE - ACCEPTABLE - W (Kg) | | | | | | | | |
| SKI LENGTH | LOWER | UPPER | LOWER | AVERAGE | UPPER | LOWER | UPPER | LOWER | UPPER |
| 190 | | | | | | | | 10 | 13 |
| 180 | | | | | | 9½ | 12½ | 10½ | 13½ |
| 170 | | | 9 | 10½ | 12 | 10 | 13 | 11 | 14½ |
| 160 | 8½ | 11½ | 10 | 11¼ | 12½ | 11 | 14 | 12 | 15½ |
| 150 | 9 | 12 | 10½ | 12 | 13½ | 11½ | 15 | | |
| 140 | 10 | 13 | 11 | 13 | 14½ | | | | |
| 130 | 10½ | 14 | | | | | | | |

In Table IV, it can be seen that the total range for the ski width to accommodate all weight groups who may use a ski of length of 160 cm is from 8½ cms to 15½ cms. The total approximate width ranges for each of the lengths of skis is set out in Table IV.

Figure 2:
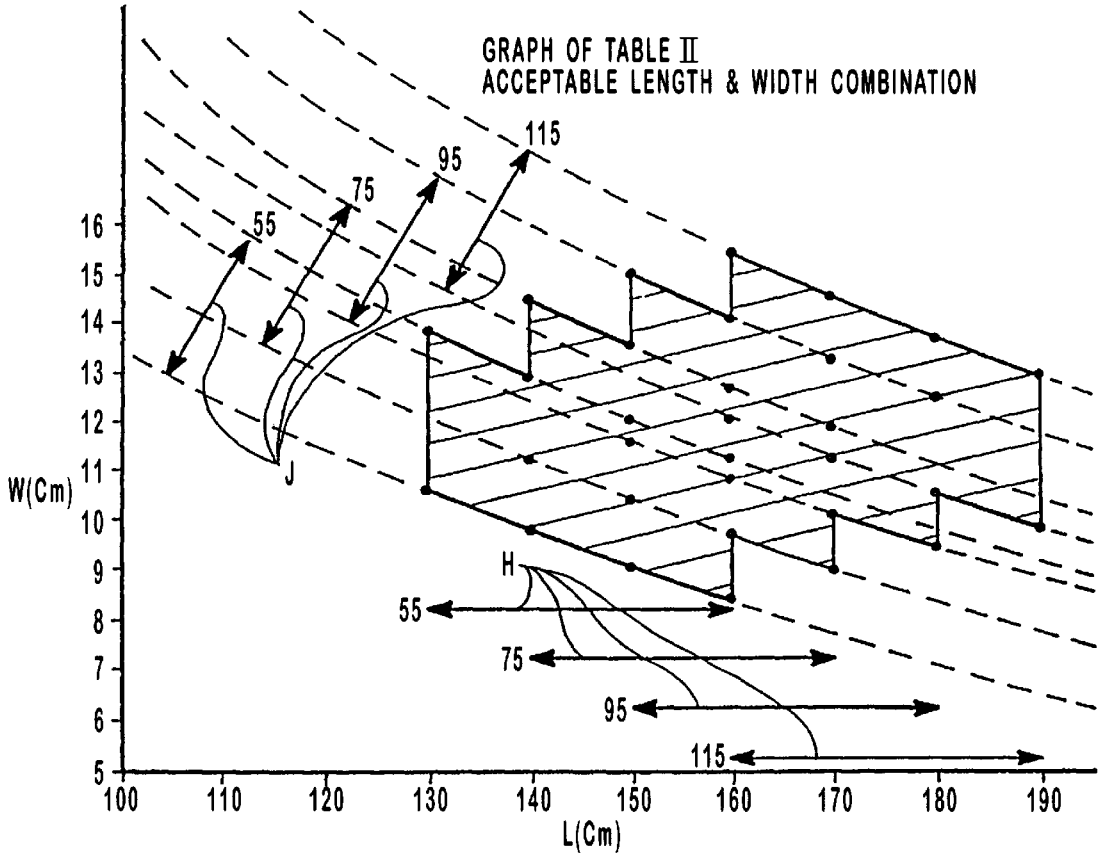
FIG. 2 is a graph, which shows the acceptable range of length verses width of a ski, for skiers of different weights.

FIG. 2 graphically illustrates the results as calculated and tabulated in Tables III and IV. The shaded area generally denotes the overall acceptable L v W combinations. The arrow H shows the range of lengths for each weight Group. It is clear, of course, that for skis of lengths between those specified, the range of widths could be obtained by interpolation. In FIG. 2, the double headed arrows J indicate the plotted lines, the shaded area between which is relevant for each weight group.

TABLE IV

| SKI LENGTH (cm) | TOTAL RANGE OF SKI WIDTH (cm) |
|---|---|
| 130 | 10½ to 14 |
| 140 | 10 to 14½ |
| 150 | 9 to 15 |
| 160 | 8½ to 15½ |
| 170 | 9 to 14½ |
| 180 | 9½ to 13½ |
| 190 | 10 to 13 |

As previously indicated, the planing/floatation principle is dependent on the aforementioned relationship between length and width of the ski. The positioning of the skier's weight with respect to the length of the ski is also of importance. For example, if the skier's weight is centered too far to the rear, the heel of the ski will sink too far into the soft snow, to produce an undesirable braking effect, whereas if the skier's weight is too far forward, the front end or tip of the ski will sink, making skiing and walking and climbing difficult. Accordingly, in association with optimising the surface area of the ski the present invention includes means to adjust the ski boot longitudinally on the ski. The adjustment is sufficiently simple that it can be performed by the skier on the slopes, to accommodate the snow conditions of the area being skied. Reference is made herein to the static balance point, which is point of balance for the skier on his skies standing on the level with the tips and rear end portions or tails of his skis sinking an equal amount in the snow. As previously indicated the balance point varies under different skiing and climbing conditions.

Figure 3:
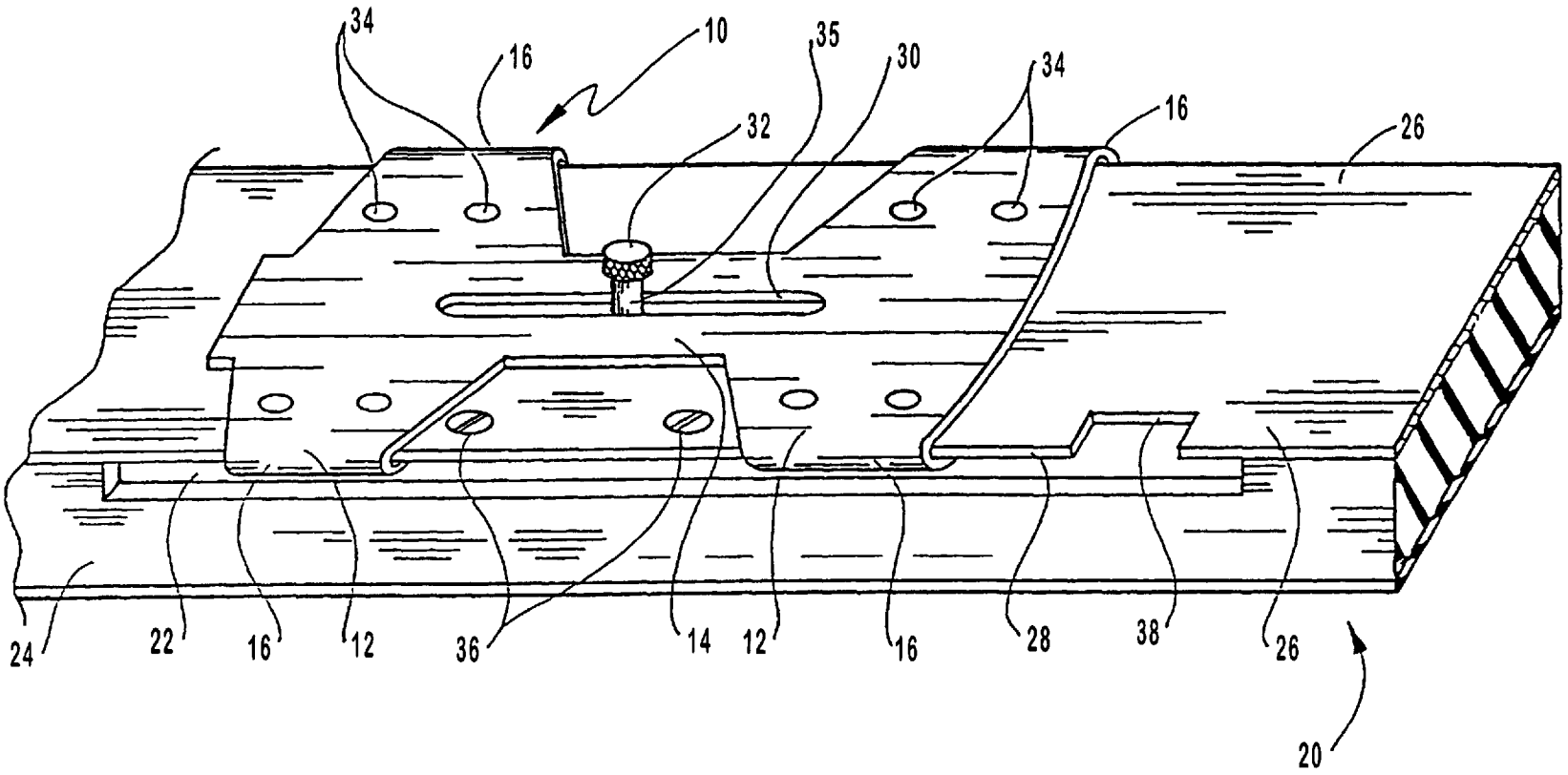
FIG. 3 is a perspective view of the binding plate of the present invention.
Figure 5:
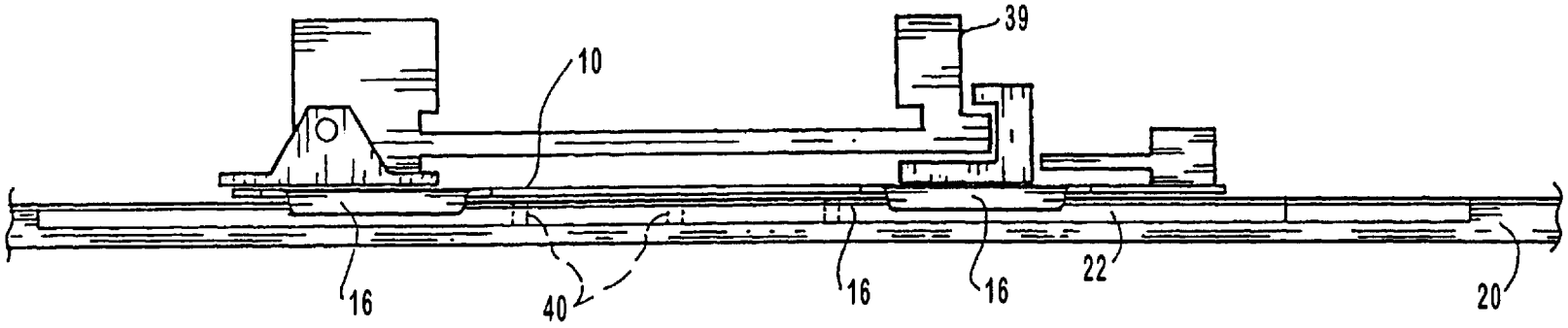
FIG. 5 is a side view of the binding plate of FIG. 4.
Figure 6:
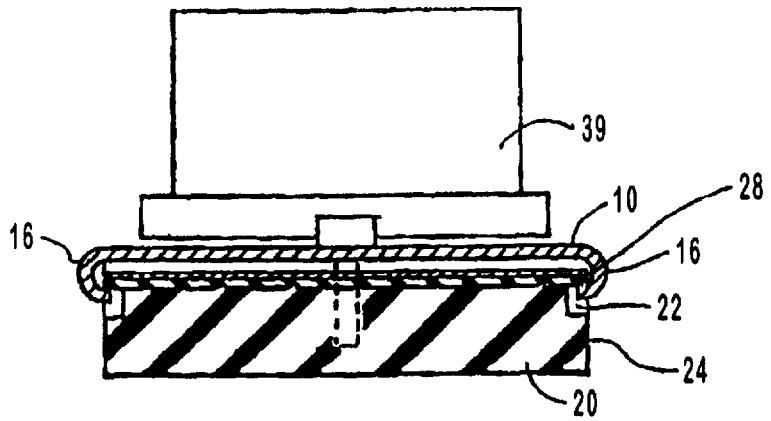
FIG. 6 is a cross sectional view of the plate of FIG. 5.

FIG. 3 is a perspective view of an embodiment of the binding plate of the present invention. The binding plate shown generally at 10 includes forward and rearward, laterally extending portions or cross members 12, and integrally formed center member 14. The outer edges 16 of each cross member 12 are bent around the corner edge of the ski 20 so as to enter a groove 22 formed in the edge 24 of the ski. Groove 22 is formed by routing, or other means, which will produce a groove or channel along either side of the ski. An upper face 26 of a metal plate or the ski provides a rail 28 for each bent portion 16 to slide along. Center member 14 of binding plate 10 has a longitudinal slot 30 through which locking means generally shown at 32 passes through. Openings 34 in the binding plate 10 provides a means for attaching a normal ski binding 39 as best shown in FIGS. 5 and 6 which may be a conventional downhill ski binding or cross-country ski bindings. Flat head screws 36 go through the upper plate 26 to provide extra support on the surface of the ski and to prevent delamination. Slot 38 is cut in the upper metal plate 26 to permit removal of binding plate 10 from ski 20. The plate is moved longitudinally on the ski until rear edge 16 of the binding plate is in alignment with slot 38 permitting the binding plate to be removed from the ski.

Figure 4:
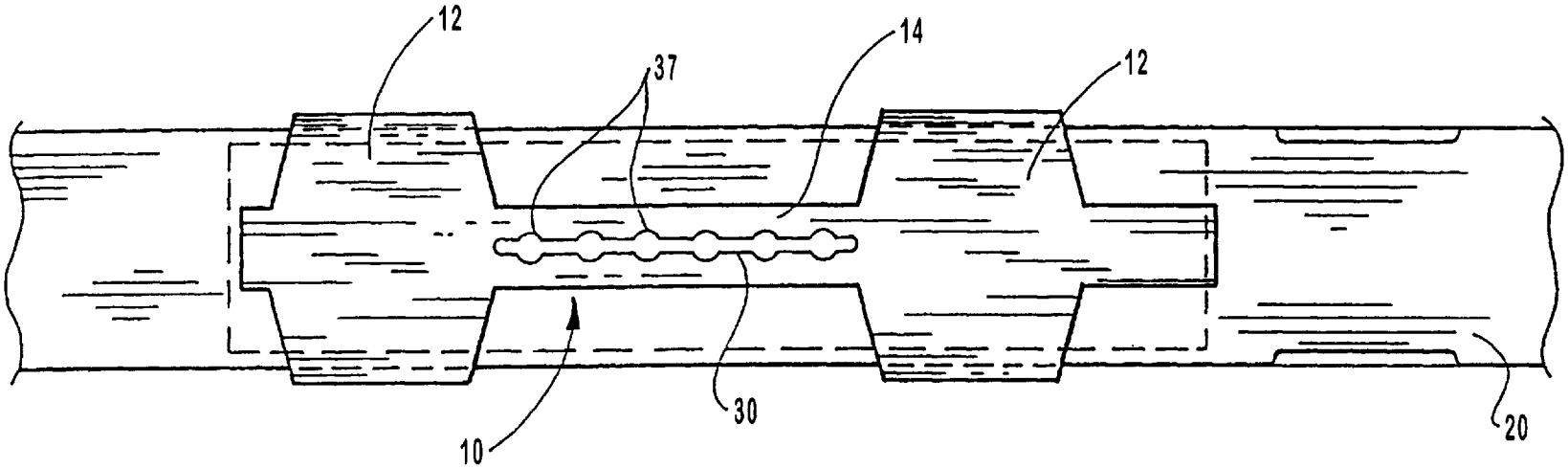
FIG. 4 is a top view of the binding plate according to the present invention attached to a ski.
Figure 7:
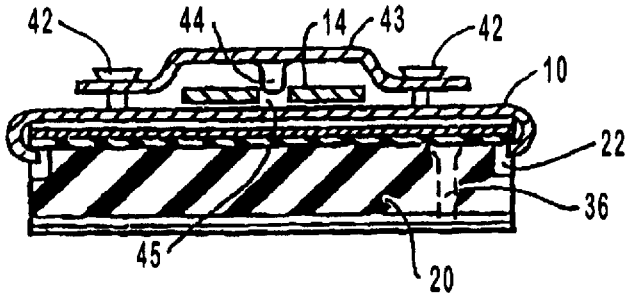
FIG. 7 is a view similar to FIG. 6 of another embodiment of the invention.

The portion of the ski immediately beneath slot 30 may be provided with an opening or regularly spaced openings 40 as best seen in FIGS. 5 and 6 if additional range of adjustment is desired. Locking means 32 as shown in FIG. 5 comprises a hexagonal or knurled headed screw having a threaded portion 35 which mates with a helicoil in one of the openings 40. By loosening locking means 32, binding plate 12 is free to slide lengthwise of the ski and may be tightened, in a new position such that the binding plate and ski bindings attached thereto are located in the optimum position along the length of the ski depending on the snow conditions. Normally, it is not necessary to completely remove the locking screw 32 as considerable adjustment can be obtained due to the length of the slot 30. However, the additional openings 40 are provided to permit the locking screw 32 to be moved so as to provide more variations in the positioning of the binding plate. Also more than one locking screw can be used at one time to provide a stronger attachment against longitudinal slippage. Slot 30 may have in a preferred embodiment countersunk holes 37 (FIG. 4) which allow a head of the locking screw to seat therein so as to more securely lock the plate in the correct position. In a preferred embodiment shown in FIG. 7, a pair of screws 42 are threaded into openings (not shown) in the ski on either side of the center member 14, and by which a small laterally extending strap or bridge member 43 is held down over the center member 42. This bridge has a small central projection 44 which mates with countersunk holes 45 in the center member, so that the binding plate may slide in a fore and aft direction when the screws 42 are loosened and then tightened after the adjustment of the under plate, and then may be locked to lock it on the ski in regularly located positions along the ski.

Figure 10:
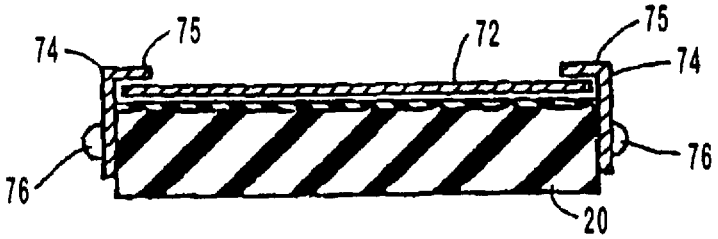
FIG. 10 is a cross sectional view of the binding plate structure shown in FIG. 9.
Figure 11:
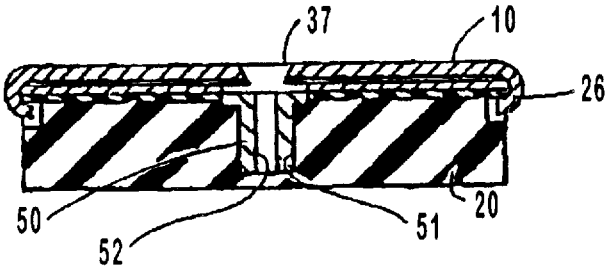
FIG. 11 is a cross section view of another embodiment of the binding plate of the present invention.
Figure 8:
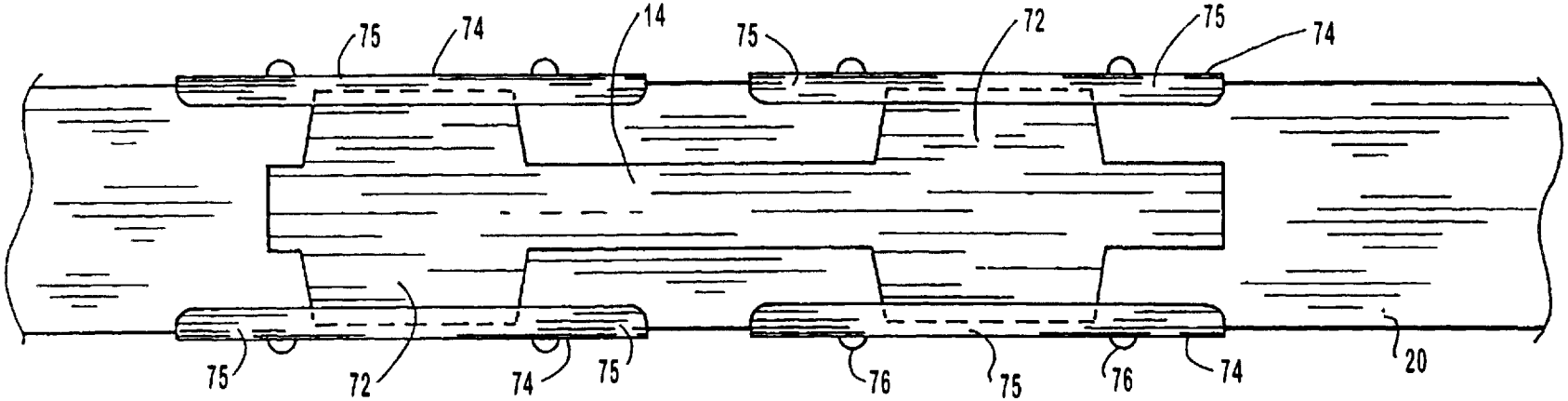
FIG. 8 is a top view of yet another alternative embodiment of the binding plate.
Figure 9:
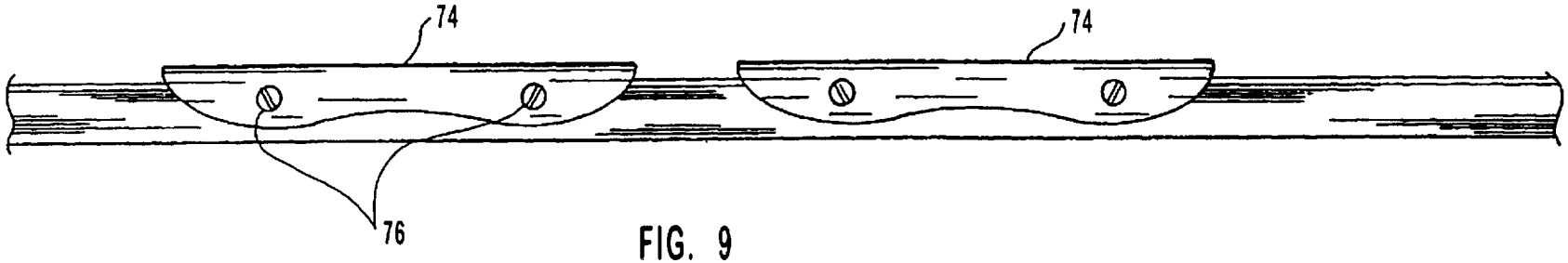
FIG. 9 is a side view of the binding plate of FIG. 8.

If the ski does not have an upper metal plate 26, the intergaging flange and channel means which allows the longitudinal sliding movement of the binder plate relative to the ski may be in the form shown in FIGS. 8, 9 and 10. In this embodiment, binding plate 72 is seen to be of a similar shape to binding plate 12 shown in the previous embodiment, but the outer edges of the plate do not curl around the side of the ski inasmuch as the upper surface of the ski does not provide a rail which will keep the binding plate in position. In this embodiment, angle members 74 are attached to the side of the ski by attachment means such as screws 76. The upper edge 75 of angle member 74 is bent inwardly to lie parallel to the upper face of the ski and spaced therefrom. The cross members 12 of the binding plate 72 are just slightly narrower than the width of the top surface of the ski so that the edges of the binding plate extends into the gap created by the bent over edge 75 of the angle member 74. Thus the binding plate is free to slide longitudinally of the ski and is prevented from twisting sideways by the angle member 74. Locking means similar to that previously described may be used in conjunct with in a slot (not shown) along central portion 14 of binding plate 72.

Figure 12:
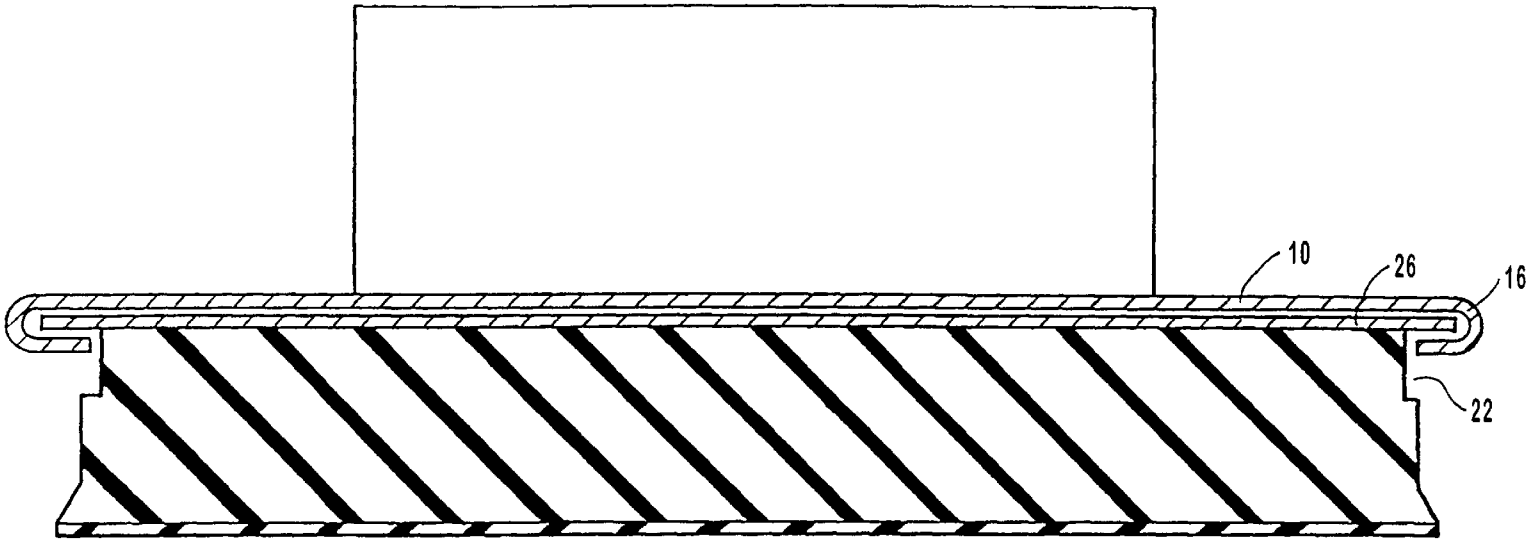
FIG. 12 is a cross section view of still a further embodiment of the present invention.

In FIG. 12 is an illustration of an alternate embodiment for use with attachment means or locking screw 32 described. In this embodiment, drill hole 51 has a threaded insert 50 glued or otherwise fixed into the hole. The insert 50 has a bore 52 which is internally threaded to receive the threaded portion 35 of locking screw 32 within the hole. Such an arrangement provides better wear characteristics to withstand repeated removal of the locking screw 32 during adjustment.

While there has been shown and described a preferred embodiment of the invention, it will be appreciated that various modifications and adaptations of the invention will become readily apparent to those skilled in the art and it is intended that such obvious modifications and adaptations be encompassed within the claims appended hereto.

Figure 13:
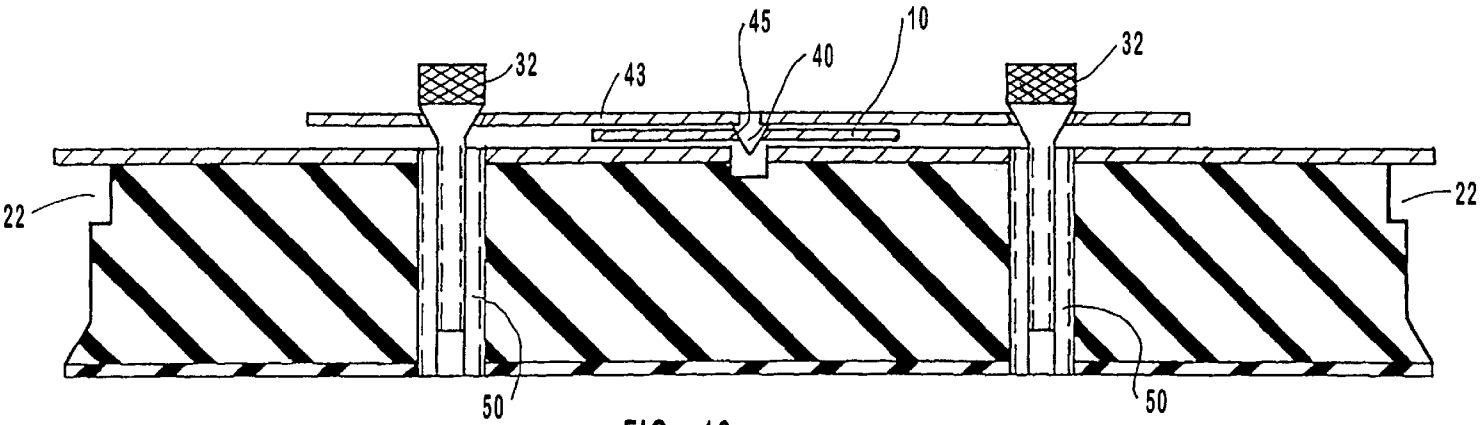
FIG. 13 is another cross section view of the embodiment.

In the embodiment shown in FIGS. 12 and 13 the upper plate 26 is slightly wider than the top surface of the ski which allows groove 22 to be shallower than that of the embodiment of FIG. 3. This feature of the shallower groove decreases any tendency of ski delamination and also reduces icing of the groove. As shown in FIG. 13 steel inserts 50 are used in openings on either side of the central portion of the binding plate 10 to receive a pair of locking screws 32. The screws 32 pass through openings 65 at opposite ends of the bridge member 43 which has a downwardly projecting portion 44 for receipt in one of a number of openings 45 spaced longitudinally in the binding plate 10.

As previously indicated the mounting of the binding plate on the ski must be such that it can move forwardly and rearwardly from the static balance point. It is preferable to have a total range of movement up to at least 15 cm. With the positioning of the slot and/or holes in the binding plate and the screw receiving holes in the ski being such that the tip of the boot can move at least 1½ cm forward at the conventional boot position on the ski to an aft position of 13½ cm. The embodiments of the present invention as described above are such that such exclusive movement can be obtained without structural stiffening of the ski which would be disadvantageous.

What I claim is:

1. A pair of short snow skis for downhill skiing, each ski of said pair having a width, length and snow engaging surface area selected to accomplish floating, planing and foot steering, each ski having a width at a widest point of the ski within a range of from about 11½ cm to about 12½ cm and a total ski length of from about 150 cm to about 165 cm.

2. A pair of skis as claimed in claim 1, wherein each ski of said pair further comprises a binding plate for adjusting a position of a ski boot worn by the skier longitudinally on the ski, the binding plate having attachment means for receiving a ski boot binding, releasable locking means for affixing the binding plate in different positions in a longitudinal direction of the ski, and the binding plate permitting the ski to flex longitudinally whereby the position of the ski boot on the ski can be adjusted to an optimum longitudinal position on the ski dependent on snow conditions.

3. A pair of skis as claimed in claim 2, wherein said binding plate includes flanges for engaging channels respectively formed along opposite side edges of the ski to accommodate relative sliding movement of the binding plate longitudinally along the ski.

4. A pair of skis as claimed in claim 3, wherein said channels are positioned relative to the length of the ski to allow positioning of said binding plate both fore and aft of a static balance point of the skier on the skis.

5. A pair of short snow skis as claimed in claim 2 wherein the binding plate includes forward and rearward, laterally extending cross members and an integrally formed center member, outer edges of each cross member being bent around to engage a groove formed in opposite edges of the ski, a top surface of the ski providing a rail for the binding plate to slide along.

6. The pair of skis as claimed in claim 5 wherein the binding plate further includes an attachment for one of a downhill ski binding and a cross country ski binding.

7. The pair of short snow skis as claimed in claim 6 wherein a position of the binding plate on the ski is secured by a screw having a threaded portion which mates with a threaded opening in a top surface of the ski.

8. The pair of short snow skis as claimed in claim 7 wherein a series of openings are provided in a top surface of the ski to accommodate a wide range of reciprocal movement of the binding plate on the ski surface.

* * * * *